United States Patent [19]

Majer

[11] Patent Number: 4,723,425

[45] Date of Patent: Feb. 9, 1988

[54] LATCH NEEDLE FOR TEXTILE MACHINE

[75] Inventor: Sigmar Majer, Balingen, Fed. Rep. of Germany

[73] Assignee: Theodor Groz & Söhne & Ernst Beckert Nadelfabrik Commandit-Gesellschaft, Albstadt-Ebingen, Fed. Rep. of Germany

[21] Appl. No.: 882

[22] Filed: Jan. 6, 1987

[30] Foreign Application Priority Data

Jan. 11, 1986 [DE] Fed. Rep. of Germany ..... 3600621

[51] Int. Cl.[4] ..... D04B 35/04

[52] U.S. Cl. ..... 66/122

[58] Field of Search ..... 66/121, 122; 112/222

[56] References Cited

U.S. PATENT DOCUMENTS

| | | | |
|---|---|---|---|
| 210,653 | 12/1878 | Adams et al. | 66/122 |
| 2,767,566 | 10/1956 | Parsons | 66/122 |
| 3,459,009 | 8/1969 | Wiederhut et al. | 66/122 |
| 3,568,472 | 3/1971 | Berentzen | 66/122 |
| 3,677,035 | 7/1972 | Wiederhut et al. | 66/122 |
| 3,934,109 | 1/1976 | Shepard | 219/121 LM |

FOREIGN PATENT DOCUMENTS

| | | | |
|---|---|---|---|
| 1159585 | 6/1964 | Fed. Rep. of Germany . | |
| 1296734 | 1/1970 | Fed. Rep. of Germany . | |
| 1203866 | 1/1960 | France | 66/122 |
| 1340474 | 9/1963 | France . | |
| 836297 | 6/1960 | United Kingdom . | |

*Primary Examiner*—Wm. Carter Reynolds
*Attorney, Agent, or Firm*—Spencer & Frank

[57] ABSTRACT

A latch needle for a textile machine. The latch needle has a latch which is displaceable in a longitudinal slot of a needle shank and is pivotally mounted by means of a continuous bearing bore on a one-piece, cylindrical shaft bolt which is inserted into corresponding coaxial bores of needle shank cheeks on either side of the longitudinal slot and is fixed therein so as to be secure against displacement. The length of the shaft bolt is less than the thickness of the needle shank along the pivot axis. The outwardly oriented, free frontal faces of the shaft bolt lie in the depth of the bores of the needle shank cheeks. Fixing elements for the shaft bolt are shaped of the material of the needle shank cheeks in the vicinity of the free frontal faces of the shaft bolt.

6 Claims, 2 Drawing Figures

LATCH NEEDLE FOR TEXTILE MACHINE

BACKGROUND OF THE INVENTION

The present invention relates to a latch needle for a textile machine, including a latch which is pivotal in a longitudinal slot of a needle shank and which is pivotally mounted by means of a continuous bearing bore on a one-piece, cylindrical shaft bolt which is inserted into a corresponding coaxial bore of the needle shank cheeks laterally delimiting the sides of the longitudinal slot and which is fixed in the needle shank cheeks so as to be secure against displacement.

Latch needles of this type are used in various textile machines, particularly in knitting machines, but also, for example, in special sewing machines.

Generally, the latch bearing must meet high demands with respect to mechanical strength and accuracy of the latch guidance, particularly if the latch needle is used in a fast moving knitting machine or for knitting with robust yarns. The wedge effects initiated by the latch during the knitting process which act on the needle shank cheeks delimiting the sides of the longitudinal slot tend to urge the needle shank cheeks apart while, simultaneously, strong leverage forces act on the shaft bolt by way of the latch.

The latch bearing by means of its bearing bore on the smooth cylindrical jacket face of a continuous shaft bolt results in a very accurate and wear resistant latch guidance. Nevertheless, latch needles having such continuous shaft bolts have lost almost all their significance today because they suffer from cheek breakage when subjected to high stresses and particularly when subjected to dynamic stresses. This is so because the end of the shaft bolt is rigidly fixed to the needle shank cheeks, for example, by screwing or welding (see German Patent No. 1,296,734) thus resulting in a rigid latch bearing arrangement which is completely inelastic in the direction transverse to the axis of symmetry of the needle. This has been found to be the cause of premature cheek breakage. Therefore, almost all of the latch needles presently employed in practice are those in which the bearing bore of the needle latch is pivotally seated on two bearing pins pressed out of the material of the needle shank cheeks as disclosed, for example, in U.S. Pat. No. 3,934,109 and British Patent No. 836,297. Due to the unpredictable flow behavior of the material of the needle shank cheeks pressed into the bearing bore, these bearing pins, which have been produced by an embossing process and are connected with the needle shank cheeks, have more or less irregular jacket faces, with the result that the load per unit of surface area of the needle latch on the bearing pin is relatively small even for a needle fresh from the factory.

SUMMARY OF THE INVENTION

It is therefore an object of the present invention to overcome this drawback and to provide a latch needle which has the advantages with respect to accuracy and wear resistance of the latch bearing of a latch needle equipped with a continuous shaft bolt and retains its full utility value over longer periods of operation without incurring the danger of cheek breakage.

The above and other objects are accomplished by the invention wherein a latch needle is provided which includes a shaft bolt whose length is less than the thickness of the needle shank at the point of the latch bearing, and the outwardly oriented frontal faces of the shaft bolt are disposed in the depth of the bores in the needle shank cheeks, and further including fixing elements for the shaft bolt which are formed of the material of the needle shank cheeks and project into the bores in the needle shank cheeks, with such fixing elements lying in the vicinity of the free frontal faces of the shaft bolt.

On the smooth cylindrical jacket face of the one-piece, continuous shaft bolt, the latch finds a proper bearing in its bearing bore with the greatest possible share of load per unit of surface area and thus the correspondingly small specific pivot bearing load per unit of surface area. The fixing elements formed in the bore in the needle shank cheeks ensure that in the course of time the shaft bolt cannot be pushed toward the outside so as to endanger the latch in its bearing. Since the needle shank cheeks are not rigidly connected with the shaft bolt, they are able to elastically yield laterally, transversely to the plane of symmetry of the needle, in the amount required at the respective moment so that the proper elasticity transversely to the axis of symmetry of the needle is assured and breakage of the needle shank cheeks is reliably prevented.

In a preferred embodiment, an annular bead of material is shaped out of the material of the needle shank cheeks to serve as fixing elements. Additionally, it is often advisable for the fixing elements to be axially spaced from the adjacent frontal faces of the shaft bolt so that the needle shank cheeks ca also unimpededly perform an inwardly oriented elastic movement if required.

Finally, it has been found to be advantageous for each outwardly oriented frontal face of the shaft bolt to lie essentially in that half of the bore in the respective needle shank cheek which is adjacent the longitudinal slot.

BRIEF DESCRIPTION OF THE INVENTION

The drawing figures illustrate one embodiment of the invention wherein.

DESCRIPTION OF THE PREFERRED EMBODIMENT

Figure 1:
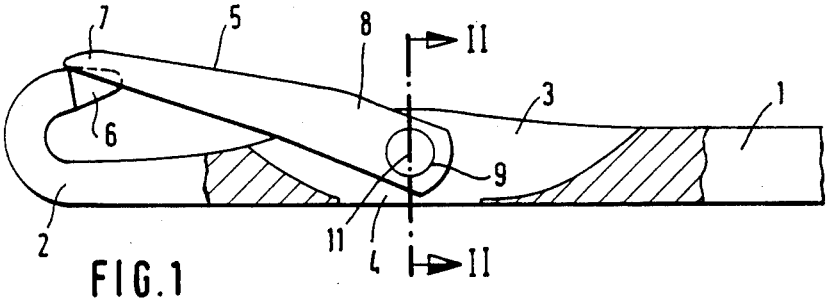
FIG. 1 shows a longitudinal view in partial cross-section of a latch needle according to the invention.
Figure 2:
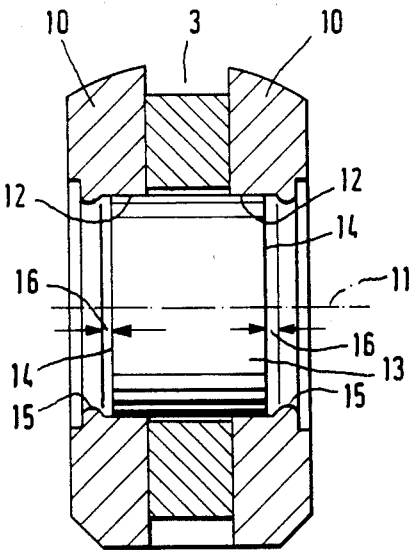
FIG. 2 is an enlarged sectional view along line II—II of the latch needle according to FIG. 1.

There is shown in FIG. 1 a latch needle which includes a needle shank 1 onto which a hook 2 is shaped in one piece and which may be equipped with feet (not shown in detail) which cooperate in a known manner with lock members of knitting machines, etc. A longitudinal slot 3 is cut into needle shank 1 symmetrically to the longitudinal center plane of the needle. This slot opens, via a passage 4 serving to discharge lint, toward the lower edge of the needle shank. A latch 5, comprised of a shank 8, is pivotally mounted in longitudinal slot 3 and is provided, at one end, with a blunt latch end 7 which covers a tip 6 of hook 2 when the needle is in the closed position. Latch shank 8, which is fitted into longitudinal slot 3 by means of its parallel sides, is provided with a bearing bore 9. Needle shank 1 has needle shank cheeks 10 (see FIG. 2) laterally delimiting longitudinal slot 3. Each needle shank cheek 10 is provided with a transverse bore 12 which is coaxial with the pivot axis 11 of latch 5. A smooth-walled, cylindrical shaft bolt 13 is inserted in a sliding seat into transverse bores 12 so as to traverse longitudinal slot 3. Bearing bore 9 of latch 5 is seated on shaft bolt 13 with very little radial bearing play, corresponding, for example, to a difference in diameters of +0.001 mm or less. Together with a very narrow latch bearing play in the axial direction between the two needle chank cheeks 10 there thus results an extremely precise and strong latch bearing which simultaneously is characterized by being resistant to wear.

Shaft bolt 13 has outwardly oriented parallel frontal faces 14 each of which lie in that half of the respective bore 12 which is adjacent longitudinal slot 3, with that half, in the illustrated embodiment, extending to approximately the middle of the depth of bore 12. The shaft bolt is axially fixed in bores 12 by fixing elements projecting into these bores and disposed in the vicinity of the free frontal faces 14 of shaft bolt 13. The fixing elements are shaped out of the material of the needle shank cheeks 10. In the illustrated embodiment, these fixing elements are spaced from each other a distance greater than the axial distance between the frontal faces 14 and have the shape of an annular bead 15 of material which lies at a small axial distance 16 from the adjacent frontal faces 14 of shaft bolt 13 in confronting relation thereto. Since the two beads 15 of material act only as axial abutments preventing unduly wide lateral displacement of bolt 13 in bores 12 and there is no rigid connection between shaft bolt 13 and needle shank cheeks 10, the latter are able to elastically yield to the side if they are subjected to corresponding alternating stresses during operation. This overcomes the danger of cheek breakage.

Instead of annular beads 15, finger or tooth like fixing elements may also be provided which are formed in the material of the sides of the needle shank cheeks 10 by means of an embossing process and correspondingly project into bores 12.

The present disclosure relates to the subject matter disclosed in German No. P 36 00 621.1 of Jan. 11th, 1986, the entire specification of which is incorporated herein by reference.

It will be understood that the above description of the present invention is susceptible to various modifications, changes and adaptions, and the same are intended to be comprehended within the meaning and range of equivalents of the appended claims.

What is claimed is:

1. A latch needle for a textile machine, comprising:

a needle shank having a longitudinal slot and needle shank cheeks on either side of, and delimiting, said slot, each cheek having a continuous bore therein coaxial with a pivot axis which is transverse to a longitudinal axis of said needle shank;

a needle latch shank having a bearing bore and being disposed in said slot with said bearing bore aligned with said pivot axis;

a one-piece cylindrical shaft bolt having outwardly oriented, free frontal faces and being axially movably disposed in both said continuous bores of said needle shank cheeks and said bearing bore of said needle latch shank so as to be movable along said pivot axis, said needle latch shank being displaceable in said longitudinal slot and pivotally mounted by said shaft bolt in said bearing bore, said shaft bolt having a length which is less than the thickness of said needle shank along said pivot axis so that each said free frontal face lies within a respective one of the continuous bores of said needle shank cheeks; and fixing elements shaped from material of said needle shank cheeks in the vicinity of said free frontal faces for limiting the length of movement of said shaft bolt along said pivot axis.

2. Latch needle as defined in claim 1, wherein each said fixing element comprises an annular bead of material shaped from the material of a respective needle shank cheek.

3. Latch needle as defined in claim 1, wherein said fixing elements are disposed at respective axial distances from the respective adjacent frontal faces of said shaft bolt.

4. Latch needle as defined in claim 1, wherein each said outwardly oriented, free frontal face of said shaft bolt lies essentially in that half of the continuous bore in the respective needle shank cheek which is adjacent said longitudinal slot.

5. Latch needle as in claim 1 wherein said fixing elements are axial abutments disposed in confronting relation to said frontal faces and are separated from each other by a distance greater than the axial distance between said frontal faces so that said shaft bolt is axially movable between said axial abutments, said shaft bolt being axially movable into abutting contact with either of said axial abutments at said frontal faces to be blocked from axial movement past said axial abutments.

6. A latch needle for a textile machine, comprising:

a needle shank having a longitudinal slot, a longitudinally extending plane of symmetry, and needle shank cheeks on either side of, and delimiting, said slot, on opposite sides of said plane of symmetry, each cheek having a continuous bore therein coaxial with a pivot axis which is transverse to a lonitudinal axis of said needle shank and perpendicular to said plane of symmetry;

a needle latch shank having a bearing bore and being disposed in said slot with said bearing bore aligned with said pivot axis;

a one-piece cylindrical shaft bolt having outwardly oriented, free frontal faces and being axially movably disposed in both said continuous bores of said needle shank cheeks and said bearing bore of said needle latch shank so as to be movable along said pivot axis, said needle latch shank being displaceable in said longitudinal slot and pivotally mounted by said shaft bolt in said bearing bore, said shaft bolt having a length which is less than the thickness of said needle shank along said pivot axis so that each said free frontal face lies within a respective one of the continuous bores of said needle shank cheeks, said needle shank cheeks being yieldable elastically and relative to said shaft bolt transversely to said plane of symmetry; and fixing elements shaped from material of said needle shank cheeks in the vicinity of said free frontal faces for limiting the length of movement of said shaft bolt along said pivot axis.

* * * * *